US009999881B2

(12) United States Patent
Hintikka

(10) Patent No.: US 9,999,881 B2
(45) Date of Patent: Jun. 19, 2018

(54) PIPETTE ADJUSTMENT WHEEL

(71) Applicant: SARTORIUS BIOHIT LIQUID HANDLING OY, Helsinki (FI)

(72) Inventor: Ville Hintikka, Espoo (FI)

(73) Assignee: SARTORIUS BIOHIT LIQUID HANDLING OY, Helsinki (FI)

( * ) Notice: Subject to any disclaimer, the term of this patent is extended or adjusted under 35 U.S.C. 154(b) by 206 days.

(21) Appl. No.: 14/385,659

(22) PCT Filed: Apr. 2, 2013

(86) PCT No.: PCT/FI2013/050358

§ 371 (c)(1),
(2) Date: Sep. 16, 2014

(87) PCT Pub. No.: WO2013/144456

PCT Pub. Date: Oct. 3, 2013

(65) Prior Publication Data

US 2015/0047457 A1 Feb. 19, 2015

(30) Foreign Application Priority Data

Mar. 30, 2012 (FI) ..... 20125369

(51) Int. Cl.
*B01L 3/02* (2006.01)
*H01H 19/14* (2006.01)
(Continued)

(52) U.S. Cl.
CPC ..... *B01L 3/021* (2013.01); *B01L 3/0224* (2013.01); *B01L 3/0237* (2013.01); *G05G 5/05* (2013.01);
(Continued)

(58) Field of Classification Search
CPC ..... B01L 3/021; B01L 3/0227; H01H 19/001; H01H 25/065
(Continued)

(56) References Cited

U.S. PATENT DOCUMENTS 4,283,950 A * 8/1981 Tervamaki ..... B01L 3/0279 422/517
5,118,474 A * 6/1992 Rogalsky ..... B01L 3/021 422/501
(Continued)

FOREIGN PATENT DOCUMENTS

EP 1 543 879 A1 6/2005
EP 1 632 840 A1 3/2006
(Continued)

OTHER PUBLICATIONS

Define adjustment—Google Search, Mar. 17, 2017.*
(Continued)

*Primary Examiner* — Vinh Luong
(74) *Attorney, Agent, or Firm* — Birch, Stewart, Kolasch & Birch, LLP

(57) ABSTRACT

An electrical pipette that includes an adjustment wheel, which comprises a primary spring defining a first adjustment area and a secondary spring defining a second adjustment area after the first adjustment area in a turning direction of the adjustment wheel. The force required for turning the adjustment wheel within the first adjustment area is smaller than within the second adjustment area, and the springs are arranged to return the adjustment wheel to its original position when the adjustment wheel is released.

13 Claims, 3 Drawing Sheets

(51) Int. Cl.

| | |
|---|---|
| ***H01H 19/00*** | (2006.01) |
| ***G05G 5/05*** | (2006.01) |
| *H01H 19/60* | (2006.01) |
| *G05G 1/08* | (2006.01) |

(52) U.S. Cl.
CPC ..... *H01H 19/001* (2013.01); *H01H 19/14* (2013.01); *G05G 1/08* (2013.01); *H01H 19/60* (2013.01); *Y10T 74/20834* (2015.01)

(58) Field of Classification Search
USPC ..... 74/557
See application file for complete search history.

(56) References Cited

U.S. PATENT DOCUMENTS

| | | | | |
|---|---|---|---|---|
| 5,187,990 | A * | 2/1993 | Magnussen, Jr. ..... | B01L 3/0227 422/926 |
| 5,613,600 | A | 3/1997 | Yokoji et al. | |
| 6,128,006 | A | 10/2000 | Rosenberg et al. | |
| 2002/0012613 | A1* | 1/2002 | Scordato ..... | B01L 3/0217 422/561 |
| 2005/0118069 | A1 | 6/2005 | Solotareff et al. | |
| 2005/0232819 | A1* | 10/2005 | Jagdhuber ..... | B01L 3/0224 422/561 |
| 2007/0229456 | A1 | 10/2007 | Pihlaja | |
| 2008/0011042 | A1 | 1/2008 | Molitor et al. | |
| 2008/0193335 | A1* | 8/2008 | Czernecki ..... | B01L 3/0227 422/400 |
| 2010/0011889 | A1* | 1/2010 | Lemmo ..... | B01L 3/0224 73/864.34 |
| 2011/0214518 | A1 | 9/2011 | Hoffmann et al. | |
| 2014/0056781 | A1* | 2/2014 | Jaaskelainen ..... | B01L 3/0217 422/501 |
| 2016/0051978 | A1* | 2/2016 | Voyeux ..... | B01L 3/022 422/522 |
| 2016/0247647 | A1* | 8/2016 | Usuya ..... | B62D 1/16 |
| 2016/0284495 | A1* | 9/2016 | Kobayashi ..... | H01H 25/06 |

FOREIGN PATENT DOCUMENTS

| | | | |
|---|---|---|---|
| FR | 2493515 | * | 5/1982 |
| JP | 2009-117303 | A | 5/2009 |
| JP | 2010-177118 | A | 8/2010 |
| WO | WO 98/10265 | A1 | 3/1998 |
| WO | WO 2012/158783 | A1 | 11/2012 |

OTHER PUBLICATIONS

Define spring constant—Google Search, Mar. 17, 2017.*
Torsion spring—Google Search, Mar. 17, 2017.*
EPO Machine Translation of JP 2010177118 (A), Ikezawa, Aug. 2010.*
Define electrical—Google Search, google.com., Sep. 10, 2017.*
EPO Machine Translation of EP1543879 (A1), Langlais et al., Jun. 2005.*
Finnish Search Report, dated Feb. 1, 2013, issued in Finnish Patent Application 20125369.
International Search Report, dated Jul. 10, 2013, issued in PCT/FI2013/050358.
Rainin:"E4 XLS Electronic Pipettes Advanced Electronic Pipette with RFID", 2011, EPOQUENET NPL, XP055035842, obtained Jan. 31, 2013.
Written Opinion of the International Searching Authority, dated Jul. 10, 2013, issued in PCT/FI2013/050358.

* cited by examiner

PIPETTE ADJUSTMENT WHEEL

BACKGROUND OF THE INVENTION

Electronic pipettes are traditionally adjusted and controlled by pressing keys. For example volume adjustment is often implemented in this way. A standard implementation is arrow keys with which the volume can be adjusted to be increased or decreased. Almost without exception, the same arrow keys are also used for other functions, for example for advancing in a menu. Conventionally a single touch of an arrow key causes a change of one adjustment step, and pressing the key for a longer period will result in an accelerated change of the reading. However, an adjustment carried out in this way has its drawbacks. The adjustment is not very fast at least in case the adjustment target value is far from the initial reading. Moreover the keys are often in connection with the display and can thus be ergonomically poorly located. There are designs where functions are adjusted using adjustment wheels, but they have not as yet brought any improvement to the speed or ease of the adjustment.

In document WO 2010/034290 A2, an electronic pipette is described, which comprises an adjustment wheel that also functions as push key. With the adjustment wheel one can select the volume, control calibration and proceed in the menu.

In document EP 1 878 500 A1, a pipette is described that has an adjustment wheel that allows, by rotating it, the selection of mode of use, for example manual pipetting, pipetting and mixing, titration and so on. This function is not connected to a push key but resides in a separate adjustment wheel.

EP 1 632 840 A1 describes a pipette having a display on its hook in front of which there is an adjustment wheel. With the adjustment wheel functions can be selected, such as the volume of the liquid to be pipetted, proceeding in the menu, calibration of the pipette, etc.

The solutions mentioned above are such in which the adjustment wheel is of the incrementally rotating type. There are also solutions having a touch screen with a touch wheel. In existing, such as those mentioned above, adjustment wheel solutions of this type the adjustment wheel is of the same type as the adjustment wheel of a car radio. This solution does not offer good control sensitivity especially when the reading needs to be changed much at once and to an accurate specific value. To speed up the adjustment in this case the wheel needs to be rotated fast in pulses for a fast change of the reading. This will easily lead to exceeding or falling short of the wanted reading, and setting the accurate reading will cause additional iteration.

BRIEF DESCRIPTION OF THE DRAWINGS

The features and advantages of the invention will now be described, by way of examples only, with reference to the accompanying drawings, in which.

DETAILED DESCRIPTION OF THE INVENTION

Figure 1:
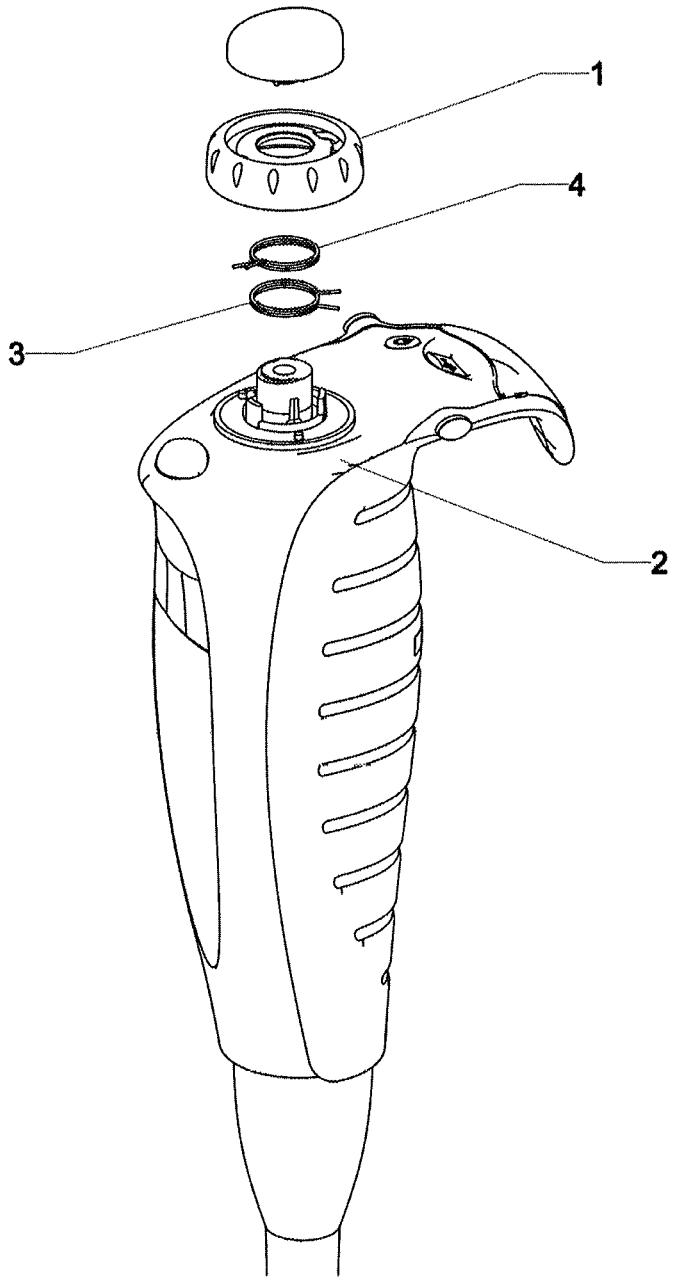
FIG. 1 depicts parts of the electronic pipette including the adjustment wheel and other components.

The system according to the invention solves the above mentioned problems with a new solution that comprises members for returning the adjustment wheel to its initial position 14 when released. This can be achieved with a spring return adjustment wheel solution. The spring return is implemented in two stages. When the adjustment wheel is first rotated (see rotation angle $\alpha$), there is initially a brief, rather light adjustment wheel movement. After this brief and light adjustment wheel movement, the spring force at first increases stepwise after which it increases towards the extreme of the movement ($\beta$).

With this solution the advantage is achieved that the stepwise or very slowly progressing adjustment and on the other hand the fast, and especially the adjustment occurring at an accelerating speed can be separated within the same member as two distinctly separate events. The angle of rotation ($\alpha$, $\beta$) of the adjustment wheel can be detected for example by a magnetic sensor or an optic reader head arrangement.

When the rotation angle of the adjustment wheel has been brought into electronic form, different speed response profiles can be developed in the control program of the pipette for optimal implementation of the turning of the adjustment wheel and the function which is to be adjusted.

When an adjustment wheel is used for programming a pipette, the adjustment is simultaneously both sensitive and very fast and interactive. The interactivity is emphasized when combined with visual feedback, for example in the form of a bar increasing with the adjustment or a sound effect.

Another significant advantage of the invention in addition to the fast, controlled adjustment is the possibility to use the adjustment wheel for directly driving the pipette in so called manual/measurement mode. This means that the operating machinery, i.e. the piston is driven freely up-and-down by the adjustment wheel. The two-step adjustment also enables the best possible touch e.g. in the so-called titration mode, in which the pipette must be able to move in a controlled manner at various speeds, but during the same run also by the smallest possible adjustment step in a stepwise manner.

The adjustment wheel is preferably situated in the upper part of the pipette, around a center column, most preferably at the top of the pipette where it is ergonomic and easy to use with one hand. That is, the adjustment wheel can be moved by a single movement of the thumb of the hand holding the pipette. This also means that all adjustments and choices made in the menu can be made easily without releasing the grip on the pipette or changing the grip and at the same time the display easily remains visible at all times.

In a preferred embodiment of the invention the movement of the piston is also controlled by the adjustment wheel. This means, therefore, that there is no need to change the grip between adjustment and pipetting.

In another preferred embodiment the operating key which is used for dispensing the liquid and which controls the movement of the piston is separate, and the adjustment wheel is set around it, functioning independently from the operating key.

Figure 2:
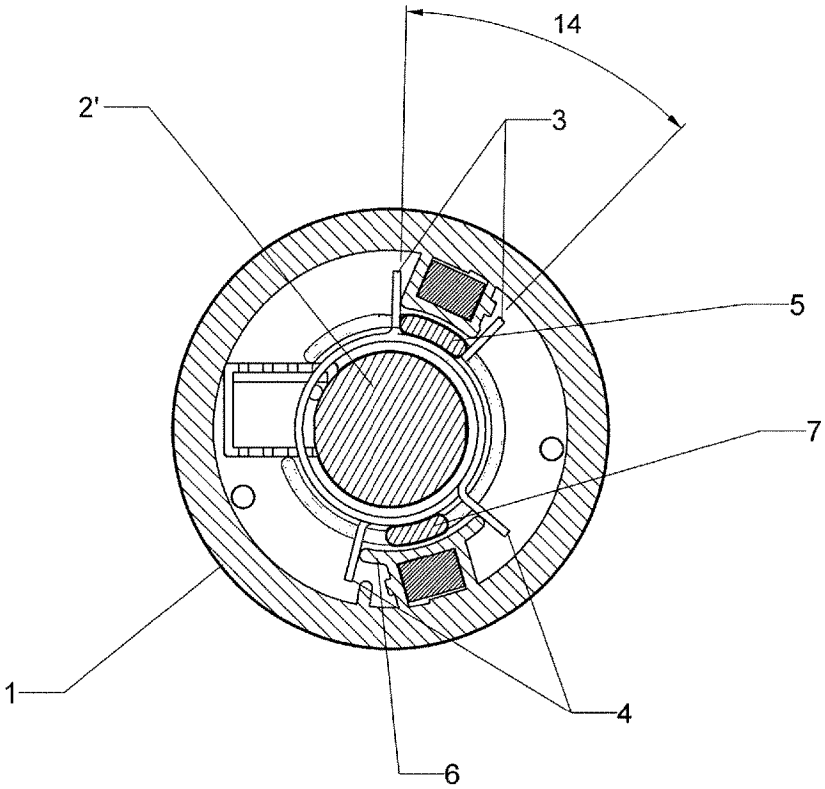
FIG. 2 depicts a top view representation of the adjustment wheel and internal components, where the adjustment wheel is in an initial position.
Figure 3:
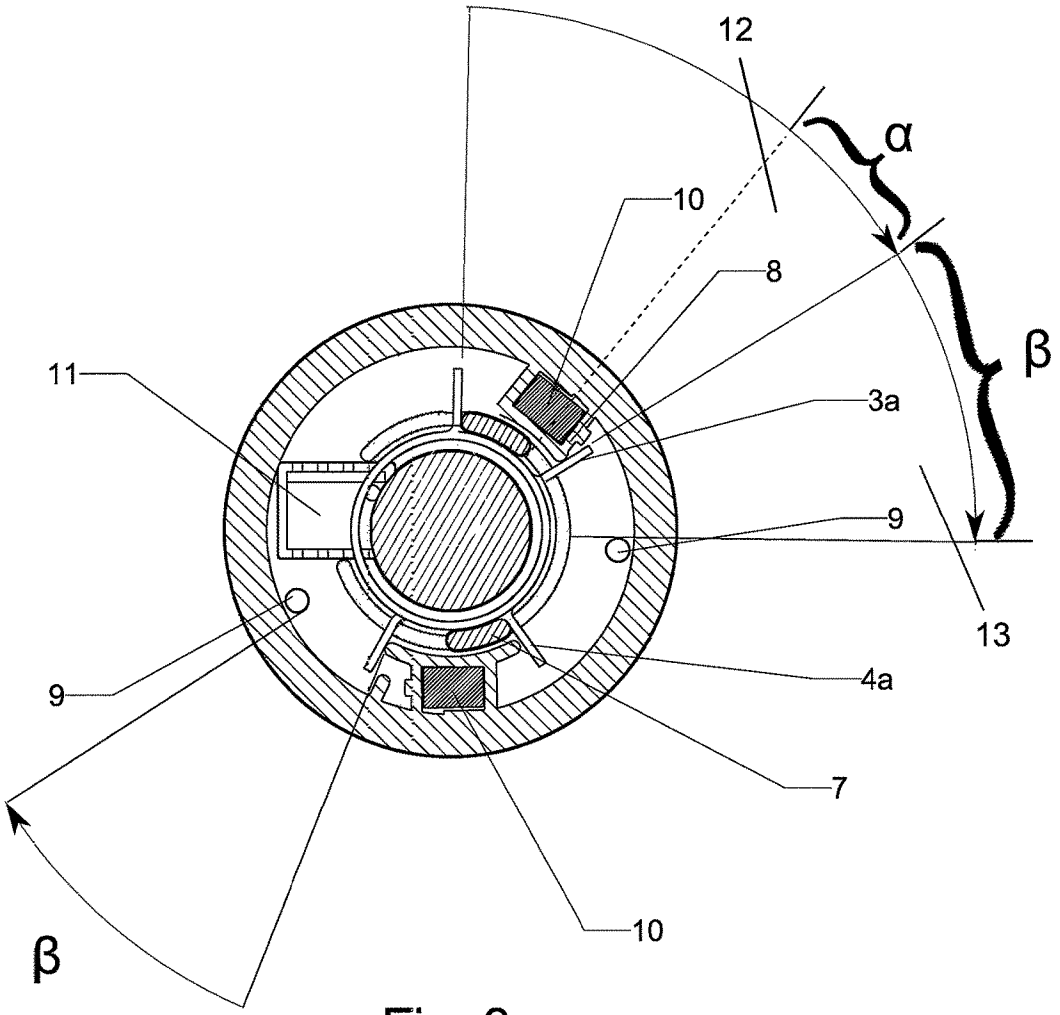
FIG. 3 depicts a top view representation of the adjustment wheel and internal components, where the adjustment wheel is turned clockwise from its initial position.

In FIGS. 1-3, a technical solution for achieving the function of the present invention is shown.

FIG. 1 illustrates parts of the adjustment wheel including the adjustment wheel 1, the primary spring 3 and the secondary spring 4 and their attachment point to the body 2 of the pipette.

In FIG. 2, the adjustment wheel 1 is installed in the body 2 of the pipette such, that it can be turned in both directions in respect of the axis, and is centrally positioned around a center column 2'. There are two torsion springs inside the wheel; the primary spring 3 and the secondary spring 4. The primary spring is installed thus, that the outward bent arms of the spring are pressed to both sides of a first shoulder 5 in the body and at the same time center the adjustment wheel to its center position. Correspondingly, the secondary spring is installed such, that the second guide 6 of the adjustment wheel is situated symmetrically in respect to a second shoulder 7 of the body.

When the adjustment wheel is turned clockwise as shown in FIG. 3, the first guide 8 engages the primary spring claw 3*a* that resists the rotational movement lightly as it moves through the rotation angle α until the second shoulder 7 of the body hits the spring claw 4*a* of the secondary spring. Then the greater force of the biased secondary spring is initially felt as a distinct stop, and as the wheel is turned further as it moves through the rotation angle β, a growing force is directed to the wheel until the movement is halted in its end position against the stop pins 9 of the body. When the wheel is released, the springs return the wheel to its original central position 14.

The figures also show the detection of the angle of rotation (α, β) implemented by magnets 10 and a magnetic sensor 11.

The sensitivity of the adjustment wheel and the threshold between the two different adjustment areas (12, 13) can be adjusted by selecting the spring constants of the spring material to be suitable for the purpose.

Instead of using torsion springs, a spring-loaded cam mechanism can be used. In this implementation the turning part has two cams, the first one immediately engaging the spring-loaded member and the second one slightly later engaging the stiffer spring-loaded member. The spring-loaded member may for example be spring steel wire, which is bent by the cam as the adjustment wheel is turned.

According to another embodiment of the invention, a spring-loaded roller is fastened at the turning part, and on the opposite side is a shape which provides an accurate two-phase centering torque profile. The spring-loaded roller can also be on the side of the body and the shape that the spring-loaded roller follows can be on the adjustment wheel side.

The invention claimed is:

1. A turnable adjustment wheel for an electrical pipette, comprising:

an adjustment wheel body that includes a first guide and a second guide and is centrally positioned around a center column;

a first shoulder;

a second shoulder;

a primary spring having two outward bent arms and centrally positioned around the center column and inside the adjustment wheel body;

the outward bent arms of the primary spring pressed against the sides of the first guide and situated symmetrically with respect to the first shoulder;

a secondary spring having two outward bent arms and centrally positioned around the center column and inside the adjustment wheel body;

the outward bent arms of the secondary spring pressed against the sides of the second guide and situated symmetrically with respect to the second shoulder;

the outward bent arms of the primary spring resisting a rotational movement of the first guide of the adjustment wheel with a first force during rotation of the adjustment wheel from an original position, where the first guide of the adjustment wheel engages the outward bent arm of the primary spring and the rotational movement defines a first angle (α), the outward bent arms of the secondary spring resisting the rotational movement of the second guide of the adjustment wheel with a second force during rotation of the adjustment wheel past the first angle (α), where the second guide of the adjustment wheel engages the outward bent arm of the secondary spring and the rotational movement between the first angle (α) and a stop defines a second angle (β);

where the second force is greater than the first force; and said springs are arranged for returning the adjustment wheel to the original position when the adjustment wheel is released.

2. The adjustment wheel for an electrical pipette of claim 1, wherein the second force increases during rotation of the adjustment wheel through the second angle (β).

3. The adjustment wheel for an electrical pipette of claim 1, wherein the second angle (β) is larger than the first angle (α).

4. The adjustment wheel for an electrical pipette of claim 1, wherein the primary spring and the secondary spring are torsion springs.

5. The adjustment wheel for an electrical pipette of claim 1, wherein the angle between the original position of the adjustment wheel and a current position of the adjustment wheel is a rotational angle, and the rotational angle is detected using a magnetic sensor.

6. The adjustment wheel for an electrical pipette of claim 1, wherein the first angle (α) is detected using a magnetic sensor.

7. The adjustment wheel for an electrical pipette of claim 1, wherein the second angle (β) is detected using a magnetic sensor.

8. The turnable adjustment wheel for an electrical pipette of claim 1, wherein the adjustment wheel body is located at the top of the electrical pipette.

9. A turnable adjustment wheel for an electrical pipette, comprising:

an adjustment wheel body that includes a first guide and a second guide and is centrally positioned around a center column of the electrical pipette;

a first shoulder of the electrical pipette;

a second shoulder of the electrical pipette;

a primary spring having two outward bent arms and centrally positioned around the center column and inside the adjustment wheel body;

the outward bent arms of the primary spring pressed against the sides of the first guide and situated symmetrically with respect to the first shoulder;

a secondary spring having two outward bent arms and centrally positioned around the center column and inside the adjustment wheel body;

the outward bent arms of the secondary spring pressed against the sides of the second guide and situated symmetrically with respect to the second shoulder;

the outward bent arms of the primary spring resisting a rotational movement of the first guide of the adjustment wheel with a first force during rotation of the adjustment wheel from an original position, where the first guide of the adjustment wheel engages the outward bent arm of the primary spring and the rotational movement defines a first angle (α), the outward bent arms of the secondary spring resisting the rotational movement of the second guide of the adjustment wheel with a second force during rotation of the adjustment wheel past the first angle (α), where the second guide of the adjustment wheel engages the outward bent arm of the secondary spring and the rotational movement between the first angle (α) and a stop defines a second angle (β);

where the second force is greater than the first force; and said springs are arranged for returning the adjustment wheel to the original position when the adjustment wheel is released.

10. The turnable adjustment wheel for an electrical pipette of claim 9, wherein the adjustment wheel body is located at the top of the electrical pipette.

11. The turnable adjustment wheel for an electrical pipette of claim 9, wherein an angle between the original position of the adjustment wheel and a current position of the adjustment wheel is a rotational angle, and the rotational angle is detected using a magnetic sensor.

12. The turnable adjustment wheel for an electrical pipette of claim 9, wherein the first angle (α) is detected using a magnetic sensor.

13. The turnable adjustment wheel for an electrical pipette of claim 9, wherein the second angle (β) is detected using a magnetic sensor.

* * * * *